United States Patent [19]

Galey et al.

[11] 4,093,553

[45] June 6, 1978

[54] TREATING MOLTEN METAL WITH A MIXTURE OF A CRYOGENIC FLUID AND SOLID CARBON BLACK

[75] Inventors: Jean Galey, Voisins Bretonneux; Gérard Bentz, Elancourt-Trappes; Pierre Karinthi, Jouy-en-Josas; Ghislain Gilbert, Bures-sur-Yvette; Serge Devalois, Fourqueux, all of France

[73] Assignee: L'Air Liquide, Societe Anonyme pour l'Etude et l'Exploitation des Procedes Georges Claude, Paris, France

[21] Appl. No.: 592,077

[22] Filed: Jun. 30, 1975

[30] Foreign Application Priority Data

Jul. 5, 1974 France ..... 74 23386

[51] Int. Cl.[2] ..... B22D 27/04

[52] U.S. Cl. ..... 252/70; 62/8; 62/45; 75/96; 164/66; 148/20.6; 148/28; 148/125; 252/9; 252/62; 252/68

[58] Field of Search ..... 252/62, 9, 372, 68, 252/70; 164/66; 62/45, 8; 75/96; 106/38.22; 148/20.6, 28, 125

[56] References Cited

U.S. PATENT DOCUMENTS

| | | | |
|---|---|---|---|
| 3,393,152 | 7/1968 | Smith et al. | 252/68 |
| 3,416,977 | 12/1968 | Rein | 148/20.6 |
| 3,798,919 | 3/1974 | Hershner | 62/45 |
| 3,868,987 | 3/1975 | Galey et al. | 164/52 |

*Primary Examiner*—Ralph S. Kendall
*Assistant Examiner*—John D. Smith
*Attorney, Agent, or Firm*—Young & Thompson

[57] ABSTRACT

A surface of molten metal is covered with a polyphase mixture of a cryogenic fluid and at least one additional constituent in the form of particles, the particles having a size less than 50 microns and forming a homogeneous and stable suspension in the boiling liquefied gas. The particles may be metal or metal oxide or glass or carbon or vegetable or mineral oil, and serve to reduce radiative heat losses from the metal by reflection and/or to serve as a lubricant of the metal in a mold.

1 Claim, 1 Drawing Figure

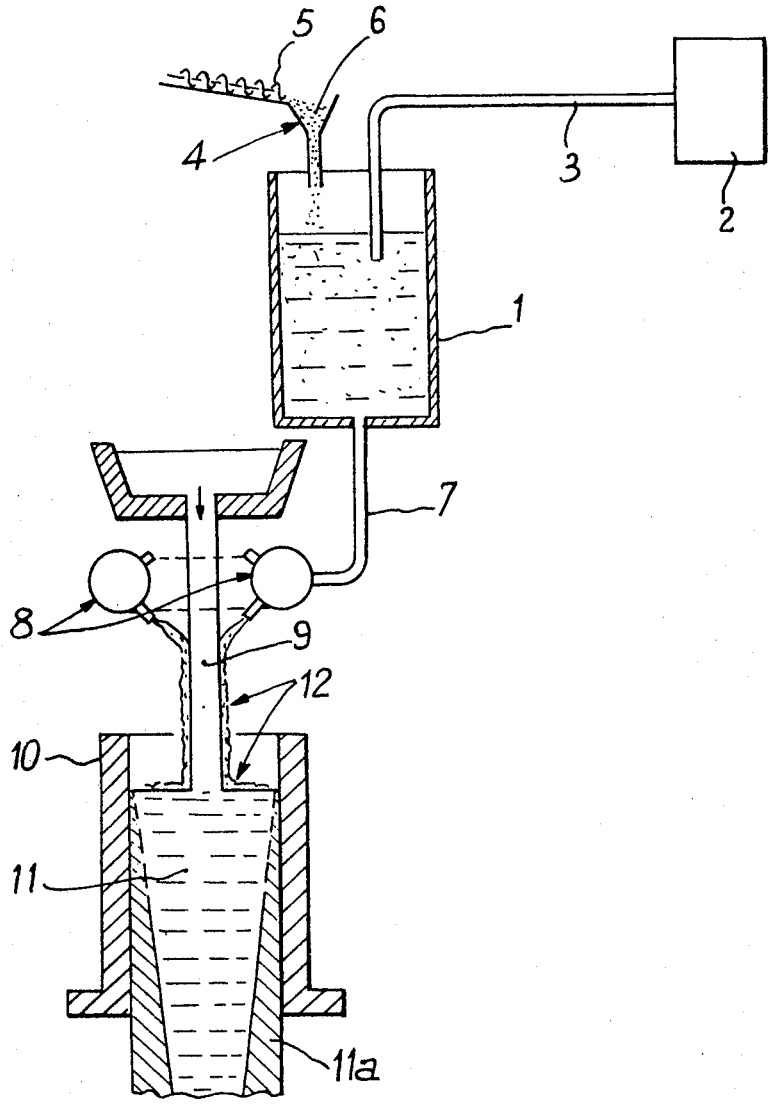
5
6
4
3
2
1
7
8
9
12
10
11
11a

TREATING MOLTEN METAL WITH A MIXTURE OF A CRYOGENIC FLUID AND SOLID CARBON BLACK

BACKGROUND OF THE INVENTION

1. Field of the Invention

The present invention imparts to composition of materials intended for metallurgical treatments and constituted by a polyphase mixture of a cryogenic fluid and at least one additional constituent in the form of particles, pre-determined properties for the purpose of said treatments, for example to give it lubricating properties or to render it absorbent or reflecting with respect to the radiation emitted by metals at high temperature.

Cryogenic fluids, and in particular liquefied gases are utilized for various metallurgical treatments.

2. Description of the Prior Art

It is known to utilize certain liquefied inert gases such as nitrogen and argon for the protection of metal or alloys molten, by covering the free or exposed surface of the metal or alloy with a film of liquefied gas in order to isolate it from the atmosphere. As a result of the phenomenon of calefaction, there is formed in the film a gaseous lower layer in direct contact with the metal and a liquid upper layer superimposed on the said gaseous layer, this double layer ensuring the protection of the metal by eliminating all contact with oxygen or water vapour contained in atmospheric air, and in consequence preventing any possibility of chemical reaction likely to pollute the said metal.

While insulation with respect to atmospheric air is one of the conditions sought for, it is generally not the only one. In fact, it is frequently important, during continuous or non-continuous pouring, to limit the heat losses to the maximum extent, that is to say to limit the cooling of the metal in fusion. In the case of continuous pouring, especially of steel or non-ferrous metals into an ingot-mould, it is furthermore essential to facilitate the downward movement of the metallic mass which solidifies in contact with the walls of the ingot-mould by lubricating it.

Studies which have been carried out in these fields have shown that the use of known cryogenic fluids, in particular liquefied inert gases such as this was carried out up to the present time, did not make it possible to satisfy completely these last two conditions.

These gases are in effect transparent to the radiation emitted by the metal at high temperature, so that this latter loses a substantial part of its heat and cools down relatively quickly, while they do not on the other hand have any lubricating action in themselves.

Furthermore, it is known to utilize, for the cooling of metals, mixtures composed of a cryogenic fluid, for example liquid nitrogen, and of a divided solid additive having particle sizes greater than 5/100ths mm., and being as much as several millimeters The function of these relatively large particles is to pass through the gaseous layer which is formed by calefaction on contact with the metal in such manner as to melt and absorb the latent heat of fusion.

This cooling technique excludes the utilization of too-fine particles, especially of particles less than 5/100ths mm., since they are conveyed through the gaseous space without reaching the metal, and in consequence the desired result cannot be obtained.

One of the objects of the present invention is generally to improve heat treatments utilizing cryogenic fluids by giving these fluids definite new properties which enable them to satisfy specific conditions required according to the nature of these treatments.

The invention has especially for its object to obtain compositions of materials formed by a cryogenic fluid at at least one additional constituent in the form of particles which, contrary to the compositions of this type at present known and contrary to liquefied gases utilized alone, may be capable of reducing the radiation losses of the metal in fusion and/or facilitating the downward movement of the solidified metal into the ingot-moulds.

SUMMARY OF THE INVENTION

To this end there is proposed according to the invention a method of giving a composition of materials definite physical and/or chemical properties, this method being characterized in that it consists of incorporating with at least one liquefied gas, at least one substance possessing intrinsically the definite properties referred to, this substance being present in the mixture in the form of particles having a sufficiently-small granular size, less than 50 microns, so as to form a homogeneous and stable suspension in the boiling liquefied gas.

Since these particles, due to their small size are in stable suspension in the liquefied gas, there is obtained a perfectly homogeneous composition having the same properties as the substance which it incorporates. It should be observed that these particles which are in suspension in the liquefied gas may themselves be present in any phase, gaseous, liquid or solid, so that the composition obtained is a polyphase composition.

According to another characteristic feature of the invention, there is incorporated, in the liquefied gases, a substance which is present, at the boiling temperature of the said gas in the solid form.

The solid form may be obtained in this case after mixture with the liquefied gas, and the substance may then be present at the ambient temperature in another phase, in the liquid or gaseous phase, for example.

According to another characteristic feature of the invention, a substance which is present in the solid phase at the ambient temperature is reduced to powder in such manner that its granular size is less then 50 microns and the powder thus obtained is then poured into the boiling liquefied gas.

It can be seen that when the substance to be incorporated in the liquefied gas is present in the solid form at the ambient temperature, the desired composition of material is obtained in a particularly simple manner.

The invention also relates, by way of a new industrial product, to a composition of materials intended for metallurgical treatments and obtained by the above specified method, this composition being characterized by the fact that the polyphase mixture of cryogenic fluid and additional constituents is a homogeneous mixture of a liquefied gas and at least one substance in the form of particles having a granular size less than 50 microns, in complete suspension in the said boiling liquefied gas.

The above-mentioned liquefied gas is preferably an inert gas such as nitrogen or helium, or alternatively a rare atmosphere gas such as argon.

The substance incorporated in the liquefied gas may be a substance having a high reflecting power for light and infra-red radiation, for example a metal, a metallic oxide or a glass.

The substance incorporated in the liquefied gas may be a substance having a high lubricating power such as carbon.

The invention is also directed to a method of treatment of molten metals utilizing the composition referred to, this method being characterized in that it consists of producing the above-mentioned mixture by utilizing an inert gas and covering the exposed surface of the metal with a layer of this mixture in order to isolate the said exposed surface from the atmosphere.

According to another characteristic feature of the method, there is incorporated in the inert gas a substance having a high reflecting power with respect to the radiation emitted by the metal, in order to reflect this radiation in the directon of the exposed surface referred to above.

In this case, the losses by radiation of the molten metal are reduced.

According to another characteristic feature of the method, there is incorporated in the inert gas a substance having a high lubricating power.

The movements of masses of metal solidified or in course of solidification are thereby facilitated.

BRIEF DESCRIPTION OF THE DRAWINGS

The FIGURE shows one embodiment of the invention.

Other characteristic features and advantages of the invention will be brought out during the course of the description which follows below, reference being made to the accompanying FIGURE given by way of example and without implied limitation, showing in a diagrammatic manner one form of embodiment of the invention applied to the continuous form of embodiment of the invention applied to the continuous pouring of a metal.

Numerous tests have been carried out in the laboratory within the scope of the present invention, with a view to trying to produce finely-divided suspensions of powders in neutral gases. The tests made with the powders already utilized in order to obtain composition materials intended to facilitate the extraction of heat from a metallic object, have shown that these powders decant very rapidly or become agglomerated into lumps. On the other hand it has been found that by utilizing powders having a very small granular size, it was possible to obtain, especially in liquid nitrogen, extremely stable suspensions, that is to say which do not form any lumps and do not decant to an appreciable extent.

Tests carried out with very fine carbon black have shown that carbon powder mixes without any difficulty with the liquefied gas, giving a homogeneous suspension of black colour.

Tests have also been carried out using other substances than carbon, in particular metals, metallic oxides and glasses, that is to say silicates of calcium, sodium or other metals, these substances being utilized in the form of powders. These tests have shown that it was possible to obtain perfectly homogeneous and stable suspensions from powders having a very small granular size.

These various results have led to making systematic measurements of granular size and it has been found that the composition obtained had adequate stability characteristics when the particle sizes of the substance incorporated in the liquefied gas were less than 50 microns.

More accurate measurements have shown that in the case of carbon for example, very good results were obtained with particles having a granular size of about 350 A. Similar measurements made with metallic powders have shown that the optimum results were obtained with powders having a granular size of between 200 and 2000 A. A The applications of the compositions of materials thus obtained, perfectly homogenous and stable, to various metallurgical treatments have proved to be extremely satisfactory.

Thus, a mixture of carbon black having a granular size of 350 A approximately in liquid nitrogen at concentrations which may vary between 10 and 1000 grams, and preferably comprised between 20 and 100 grams per liter of liquefied gas, was utilized to protect molten metals in continuous pouring. In addition to the protective effect with respect to the atmosphere obtained with liquid nitrogen alone, these compositions of materials have ensured a lubricating effect due to the fine particles of carbon which are deposited on the metal in contact with the walls of the ingot-mould, and an absorption effect of the radiation emitted by the liquid metal.

Tests have also shown that the fact of putting the carbon in suspension in the liquid nitrogen makes it possible to utilize only the quantity of carbon which is just necessary for the lubrication effect, whereas in current practice in which the carbon is in the form of powder, the quantities employed must be much larger. In addition, this carbon in suspension does not pollute the environment as does carbon dust, since the particles of carbon are trapped in the liquefied gas.

Tests made by employing, instead of carbon black, metallic powders, metallic oxides or glasses in the liquid nitrogen and by using the compositions thus obtained for the protection of the exposed surfaces of molten metal, have shown that there was obtained, in addition to the protective effect referred to above the respect to the atmosphere, a very substantial reduction in the losses by radiation due to that fact that the light or infra-red rays emitted by the metal are reflected by particles in suspension in the direction of the metal itself and in consequence are not dispersed as a pure loss in the ambient atmosphere.

Metals which have given good results are aluminium, titanium, zirconium, niobium, calcium, magnesium and lithium and these metals can be used alone or in mixtures. Metallic oxides which have given good results are the oxides of these same metals used alone or in mixtures. The optimum concentrations in the case of metals, metallic oxides or glasses are also comprised between 10 and 1,000 grams per liter of liquefied gas, and preferably between 20 and 100 grams per liter of liquefied gas.

Tests have also shown that the preparation of the suspension is extremely easy since it is only necessary to pour the appropriate quantity of powder into the liquefied gas, stirring being effected by the movements of convection due to the boiling of the gas. It is therefore not necessary to provide agitator devices or other more or less complicated apparatus in order to obtain a homogeneous mixture. The immediate result is that the mixture can be prepared just before the utilization of the composition of materials.

DESCRIPTION OF THE PREFERRED EMBODIMENT

There has been shown in the accompanying drawing an example of the use of the invention applied to the protection of a molten metal in continuous pouring into an ingot-mould. There has been indicated at 1, for example a dewar flask, into which liquid nitrogen is fed through a conduit 3, coming from a source 2 under pressure. Above the receptacle 1 is located a hopper 4 or the like supplied by an Archimedean screw 5 with carbon black having a granular size of about 350 A.

The carbon black 6 falls directly from the hopper 4 into the liquefied gas contained in the receptacle 1 and mixes with this latter to give a homogeneous and stable suspension of black colour. The composition of materials thus obtained is fed, through the intermediary of an evacuation conduit 7 to a device 8 of known type, known as a "phase separator" which is provided to separate the gaseous phase from the liquid phase of the liquefied gas and to project this latter on the jet 9, of molten metal which flows into the continuous-pouring ingot-mould 10.

The liquid layer 12 containing the carbon in suspension which flows along the jet 9 and covers the upper surface of the mass of liquid metal 11 in the ingot-mould, effectively protects the free surfaces of the metal from the action of the atmosphere. Furthermore, the lubricating effect of the particles of carbon substantially improves the downward flow of the solidified metal 11*a* along the walls of the ingot-mould, the lubrication facilitating the friction of the external part of the profile which is solidifying.

While utilizing the same apparatus as that shown in the drawing, it would be possible to replace the carbon black by a metallic powder, for example an aluminium powder having also a granular size of about 350 A. The liquid layer also protects the free surfaces of the metal against the action of the atmosphere and practically prevents its cooling by reason of the reflection by the aluminium particles of the light and infra-red radiation emitted by the metal.

By the simple addition of a carbon powder or a metallic powder to the liquid nitrogen, and utilizing a known apparatus, there is thus obtained a very considerable improvement in the conditions of continuous pouring of a metal.

By means of such a composition of materials formed by a mixture of liquid nitrogen and carbon black, it is of course possible to ensure the protection of free surfaces of molten metals in a stationary mass in the furnaces, ladles, moulds or the like, or alternatively of the free surfaces in horizontal movement, for example a metal flowing in a spout.

It is clear that the invention is not in any way limited to the examples of construction described and shown, which have only been given by way of example. It is in fact capable of finding numerous applications in other technical fields, in particular the tempering of metals. Similarly, the lubricating substance may be fluid, for example a mineral or vegetable oil. This oil may be incorporated in the liquefied gas covering a layer of metal in fusion in the ingot-mould.

What we claim is:

1. A composition of material intended for metallurgical treatments, comprising a body of at least one cryogenic fluid at its boiling temperature, and suspended in said body of cryogenic fluid finely divided carbon black in the form of particles having a size between 200 and 2,000 A, said cryogenic fluid being selected from the group consisting of nitrogen, helium, and argon, and said carbon black being present in said cryogenic fluid in a quantity between 10 and 1,000 grams per liter of cryogenic fluid, whereby a homogeneous stable suspension is maintained in said cryogenic fluid.

* * * * *